US006924772B2

(12) United States Patent
Kiernan, Jr. et al.

(10) Patent No.: US 6,924,772 B2
(45) Date of Patent: Aug. 2, 2005

(54) TRI-MODE CO-BORESIGHTED SEEKER

(75) Inventors: Sherwood C. Kiernan, Jr., Dayton, MD (US); Donald J. Walker, Catonsville, MD (US); Daniel E. Stamm, Baltimore, MD (US); William B. Yablon, Elkridge, MD (US); Paul M. Dishop, Linthicum Heights, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/695,750

(22) Filed: Oct. 30, 2003

(65) Prior Publication Data

US 2005/0093757 A1 May 5, 2005

(51) Int. Cl.[7] ..... H01Q 21/00

(52) U.S. Cl. ..... 343/725; 343/720; 343/754; 343/781 CA

(58) Field of Search ..... 343/720, 725, 343/754, 781 CA

(56) References Cited

U.S. PATENT DOCUMENTS 4,477,814 A * 10/1984 Brumbaugh et al. ..... 343/725
4,652,885 A * 3/1987 Saffold et al. ..... 343/725
4,698,638 A * 10/1987 Branigan et al. ..... 343/725
5,182,564 A * 1/1993 Burkett et al. ..... 342/53
5,214,438 A * 5/1993 Brusgard et al. ..... 343/725
5,307,077 A * 4/1994 Branigan et al. ..... 343/720
5,327,149 A * 7/1994 Kuffer ..... 343/720
5,451,969 A * 9/1995 Toth et al. ..... 343/781 CA
6,060,703 A 5/2000 Andressen ..... 250/203.6
6,606,066 B1 * 8/2003 Fawcett et al. ..... 343/725

* cited by examiner

*Primary Examiner*—Don Wong
*Assistant Examiner*—Leith Al-Nazer
(74) *Attorney, Agent, or Firm*—Birch, Stewart, Kolasch & Birch, LLP

(57) ABSTRACT

A tri-mode co-boresighted seeker including a primary collecting mirror assembly having a parabolic surface and a forwardly located dielectric secondary mirror assembly including a dielectric mirror coating which reflects infrared (IR) energy to an IR detector assembly located on a central longitudinal axis on one side of the secondary mirror while providing substantially unobstructed propagation of millimeter wave RF energy and laser energy in a joint or common signal path therethrough to means located on the other side of the secondary mirror for extracting and diverting laser energy away from the common RF-optical signal path to a laser sensor assembly while causing little or no disturbance to the RF signal as it propagates to a co-located bifurcated waveguide assembly which couples the RF energy to an RF sensor means located behind the primary mirror.

27 Claims, 9 Drawing Sheets

FIG. 14
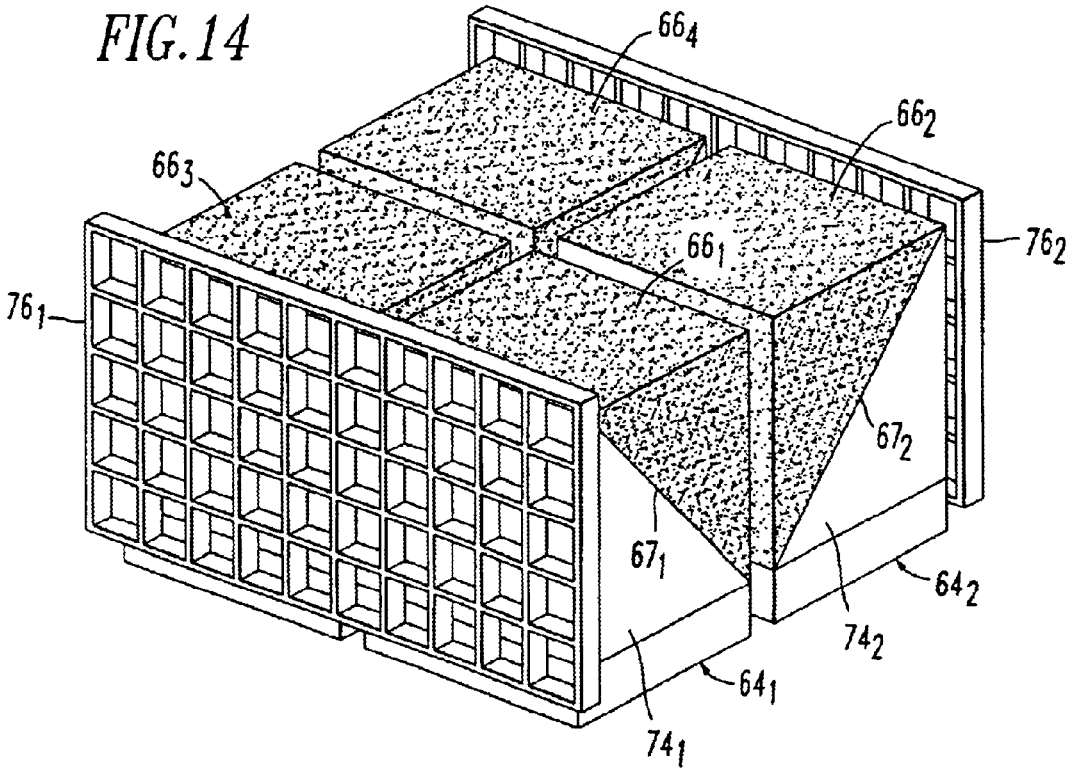
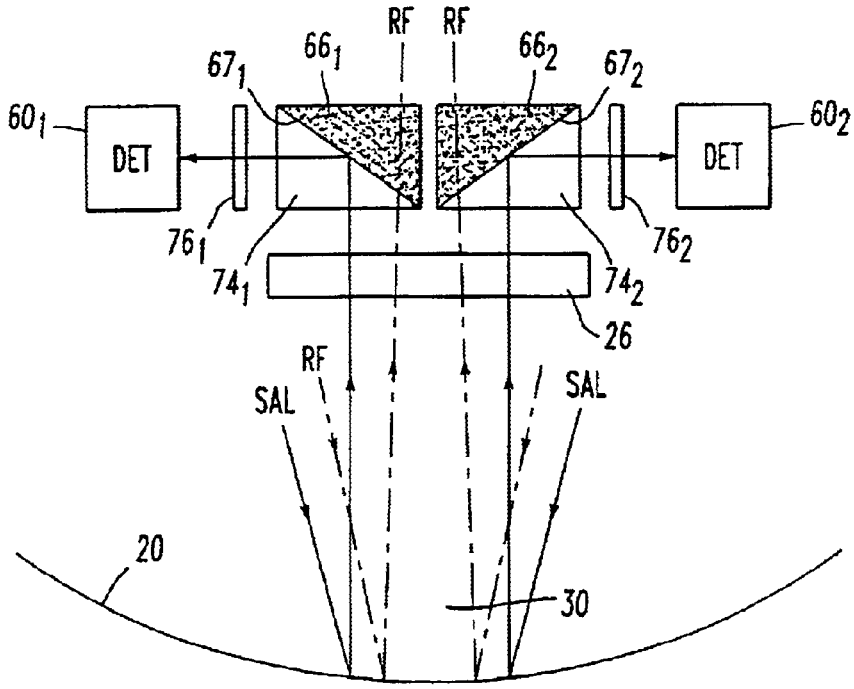
FIG. 15

TRI-MODE CO-BORESIGHTED SEEKER

BACKGROUND OF THE INVENTION

1. Field of the Invention

This invention relates generally to a multi-mode sensor system located in a common transmitting/receiving aperture and, more particularly, to a tri-mode, co-boresighted sensor system located on an airborne platform, such as a missile seeker.

2. Description of Related Art

Single mode sensors used, for example, in missile seekers are well known in the state of the art but typically exhibit degraded performance because of false target acquisitions. In order to overcome this inherent deficiency, a dual-mode seeker including millimeter wave (MMW) and infrared (IR) sensors in a common aperture have been developed. One such system is shown and described in U.S. Pat. No. 5,214,438, entitled "Millimeter Wave and Infrared Sensor in a Common Receiving Aperture", issued to T. C. Brusgard et al. on May 25, 1993. More recently, a tri-mode seeker additionally including a laser spot tracker has been developed by the assignee of the present invention and is shown and described in U.S. Pat. No. 6,606,066, entitled, "Tri-Mode Seeker" issued to J. M. Fawcett et al. on Aug. 12, 2003, the details of which are incorporated herein by reference.

In the Fawcett et al patent, the RF transmitter/receiver is located at the focus of a primary reflector located on a gimbal assembly. A selectively coated dichroic mirror is located in the path of the millimeter wave energy so as to reflect infrared energy from the primary reflector to an optical system which re-images the infrared energy on an infrared detector. The outer edge or rim of the primary reflector is additionally deformed so that incoming laser energy focuses to a location beyond the RF transmitter/receiver. A laser sensor is positioned adjacently behind the RF transmitter/receiver in a back-to-back orientation. The laser energy is then detected using a secondary reflector and an optical system which directs the laser energy from the secondary reflector to a laser detector. In such a configuration, the reception of laser energy is restricted to a relatively small zone on the outer periphery of the primary mirror, thus restricting the collecting aperture since it severely limits the amount of laser energy which can be detected. Also, the packaging is awkward and crowded, severely reducing the overall packaging efficiency.

Additionally, propagating a laser wavelength to the IR focal plane has also been attempted, but it degrades IR performance due to the limited selection of materials that pass all desired wavelengths and their color properties which make it impossible to fully color correct the optical design, particularly over the IR band. The constraints on material selections also raise an issue of electromagnetic interference (EMI) susceptibility in the IR detector apparatus.

Another attempt in the development of a tri-mode seeker placed the laser sensor at an intermediate image location, i.e., between the secondary mirror and the relay optics cell. While this offers a significant advantage to the IR path since the color correction and EMI issues are removed, there are other significant limitations which remain. These include distortion of the IR wave front and loss of image quality and a lack of volume for packaging the necessary support electronics. Also a narrow band filter is required for the laser sensor so that it can reject solar background. This location makes coating design very difficult, if not impossible, by demanding the coating also pass the IR band while imposing a wide range of incident angles that it must accommodate.

Thus, all prior approaches have inherent limitations which impose some form of penalty and/or difficulty in a suitable overall system design.

SUMMARY

It is an object of the present invention, therefore, to provide an improvement in multi-mode sensors.

It is another object of the present invention to provide an assembly of multi-mode sensors located in a common transmitting/receiving aperture.

It is still another object of the invention to provide a tri-mode seeker including RF, IR and laser sensors wherein each of the three sensors commonly and simultaneously use the same available surface area of the system collecting aperture.

It is a further object of the invention to provide a multi-mode seeker having co-located focal positions for laser and RF signals while traveling the same signal path through the elements of the same optical assembly.

It is still yet another object of the invention to provide a tri-mode seeker providing extraction and diversion of optical signals from a joint or common RF optical signal path while causing substantially no disturbance to the RF signal as it propagates in the signal path.

It is still yet another object of the invention to provide a tri-mode co-boresighted seeker that permits all three signal modes to utilize the full primary mirror aperture while providing two beam splitting actions so that all three signals are collected in different locations with minimal interference with or impact on each other.

These and other objects are achieved by a tri-mode co-boresighted seeker including a collecting aperture comprising a primary mirror having a parabolic surface and a forwardly located dielectric secondary mirror including a dielectric mirror coating which reflects infrared (IR) energy to an IR detector assembly while providing substantially unobstructed propagation of millimeter wave RF energy and laser energy in a joint or common signal path therethrough to means for extracting and diverting laser energy from the common RF-optical path while causing little or no disturbance to the RF signal as it propagates to a bifurcated waveguide assembly which couples the RF energy to a detector located behind the primary mirror. The means for extracting the laser energy consists of a set of four orthogonally located light pipes or prisms which have reflecting surfaces for directing laser energy outwardly to laser detectors located to the side of the RF-optical path. Such a configuration permits the three sensors, i.e., the RF, IR and laser sensors to commonly use the same useable portion of the collecting aperture of the primary mirror simultaneously.

Further scope of applicability of the present invention will become apparent from a detailed description provided hereinafter. It should be understood, however, that the detailed description and specific examples, while disclosing the preferred embodiments of the invention, it is provided by way of illustration only, since various changes and modifications coming within the spirit and scope of the invention will become apparent to those skilled in the art from this detailed description.

BRIEF DESCRIPTION OF THE DRAWINGS

The present invention will become more fully understood when considered in conjunction with the accompanying drawings which are provided by way of illustration only, and thus are not meant to be considered in a limiting sense, and wherein:

FIG. 14 is an isometric view of an assembly of four beam-splitting prisms for extracting and diverting the laser energy from the common signal path shown in FIG. 13; and FIG. 15 is a diagram illustrative of the common RF and laser energy propagation path in the elements shown in FIGS. 12–14.

DETAILED DESCRIPTION OF THE INVENTION

Figure 1:
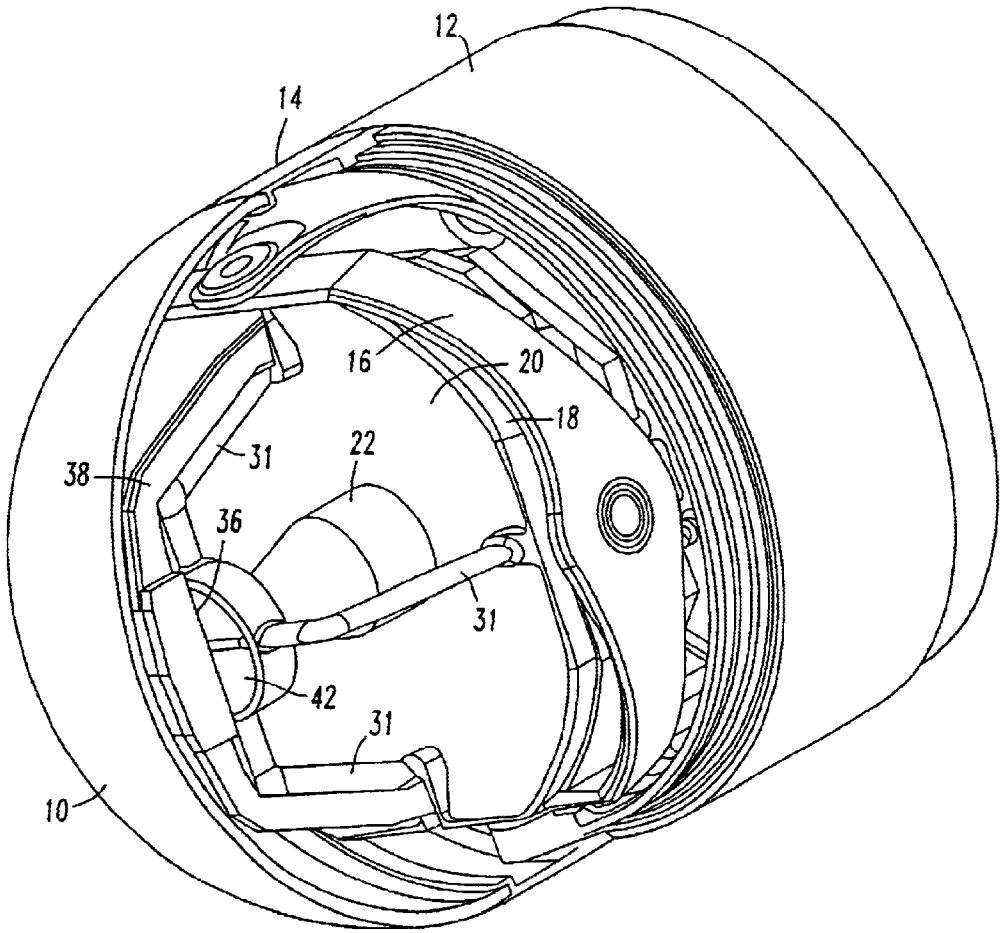
FIG. 1 is a partially cut-away isometric view of a first embodiment of the subject invention.

This invention is directed to a common aperture for three sensors of millimeter wave (MMW), infrared (IR) and semi-active laser (SAL) energy which are aligned on a common boresight or central longitudinal axis (CL) of seeker apparatus used, for example, in an airborne platform such as a missile and which allows all three modes to simultaneously use the full transmitting/receiving aperture.

Referring now to the drawings wherein like reference numerals refer to like components throughout, reference is first made to FIGS. 1–9 which disclose the details of a first embodiment of the invention. Reference numeral 10 denotes the radome of a tri-mode seeker assembly including an annular base member 14 to which is secured a housing 12 for supporting a gimbal assembly 16 as well as attachment of the radome 10. A primary mirror assembly 18 including a parabolic reflecting surface 20 is mounted on the gimbal assembly 16 so that it can be controlled to move independently in two orthogonal directions. The primary mirror assembly 18 includes a central opening through which is located an infrared sensor assembly including an (IR) relay optics cell 22 and an axially coupled detector/dewar assembly 24 which are located in a central longitudinal axis shown in FIG. 2 as CL. The signal output of the IR assembly 24 is fed to an IR imaging circuit board assembly 25.

Figure 4:
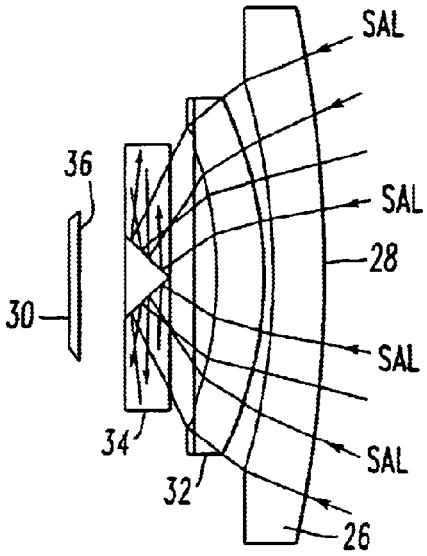
Figure 5:
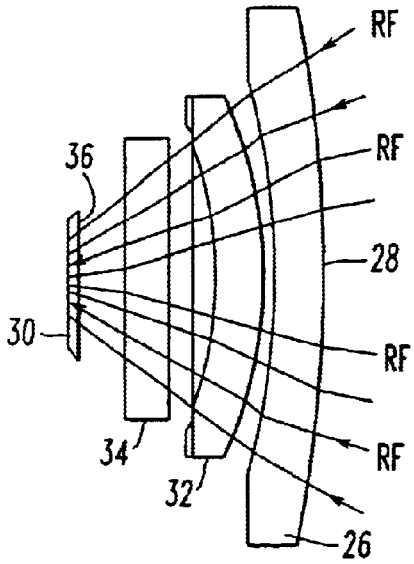
Figure 6:
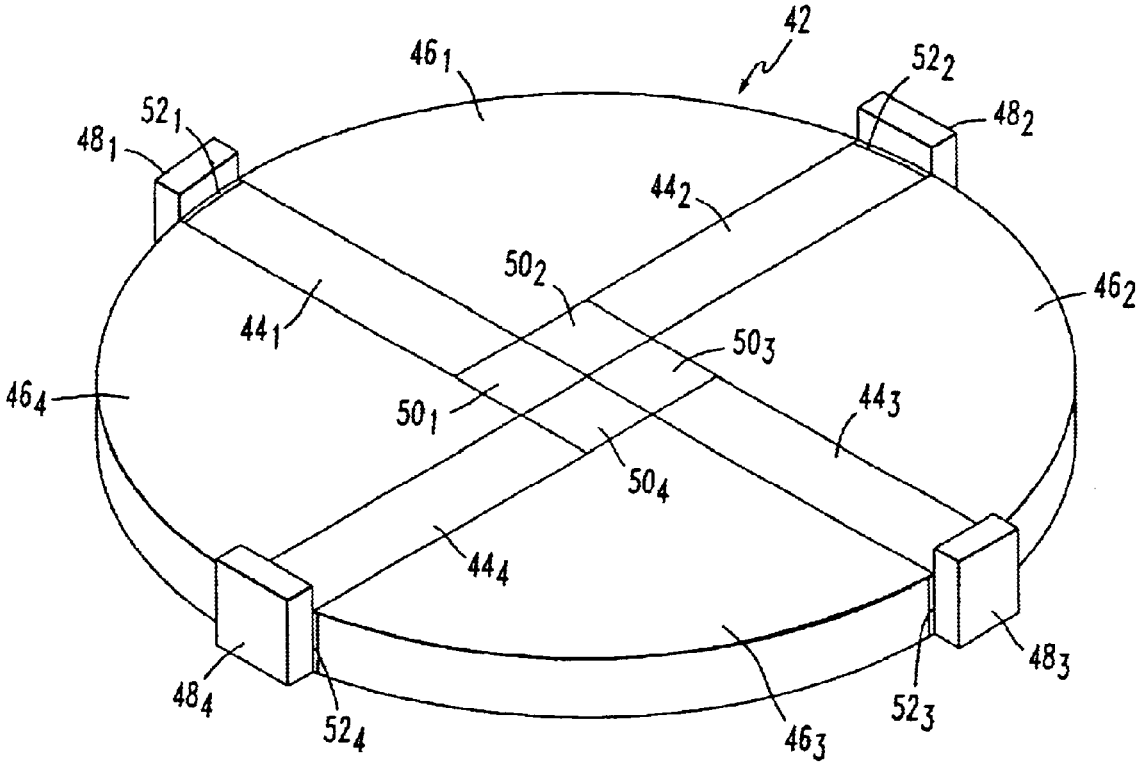
FIG. 6 is a perspective view of an orthogonal arrangement of light pipes for extracting and diverting the laser energy from a common RF-optical energy path in the embodiment shown in FIGS. 1 and 2.
Figure 7:
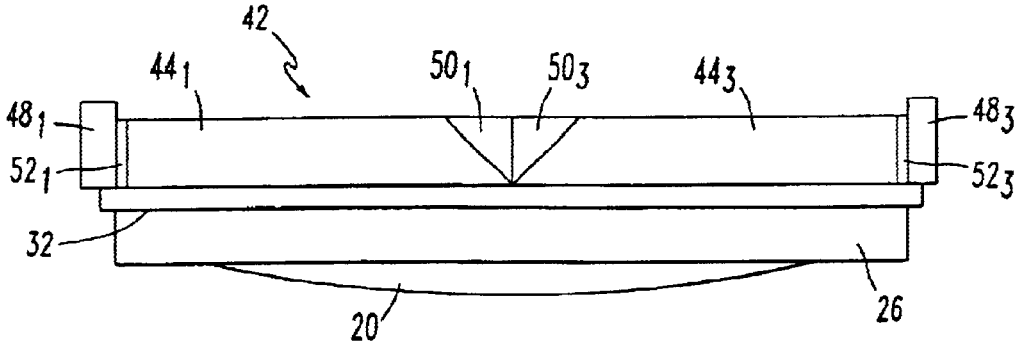
FIG. 7 is a side view illustrative of the arrangement of the elements shown in FIG. 6 as well as the secondary lens shown in FIG. 2 as well as an intermediate diffraction lens.
Figure 8:
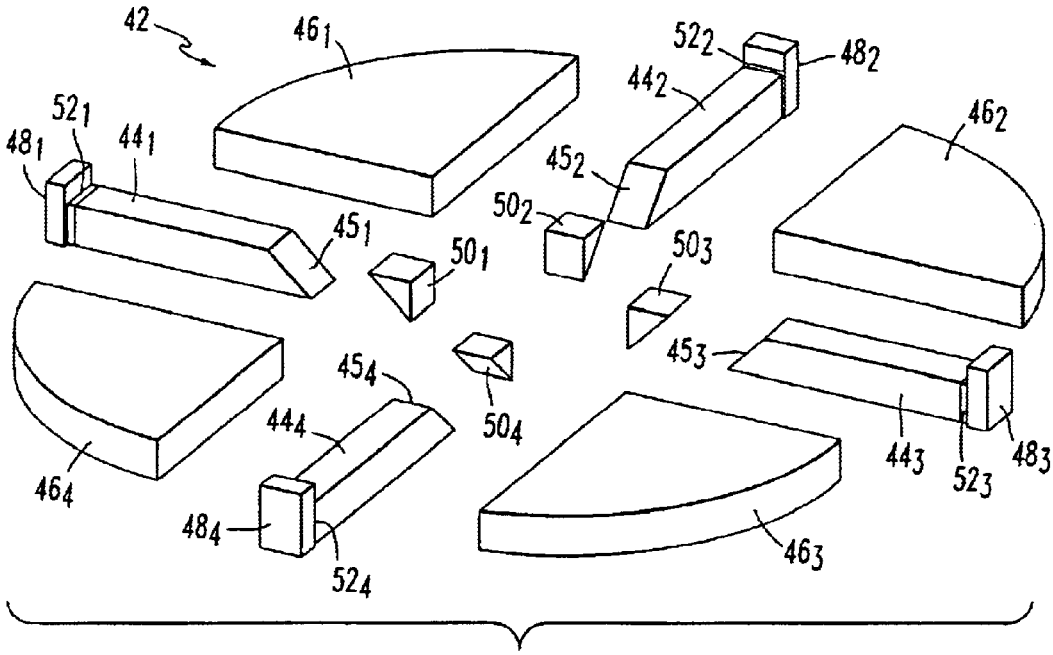
FIG. 8 is an exploded view of the components of the light pipe arrangement shown in FIG. 6.
Figure 9:
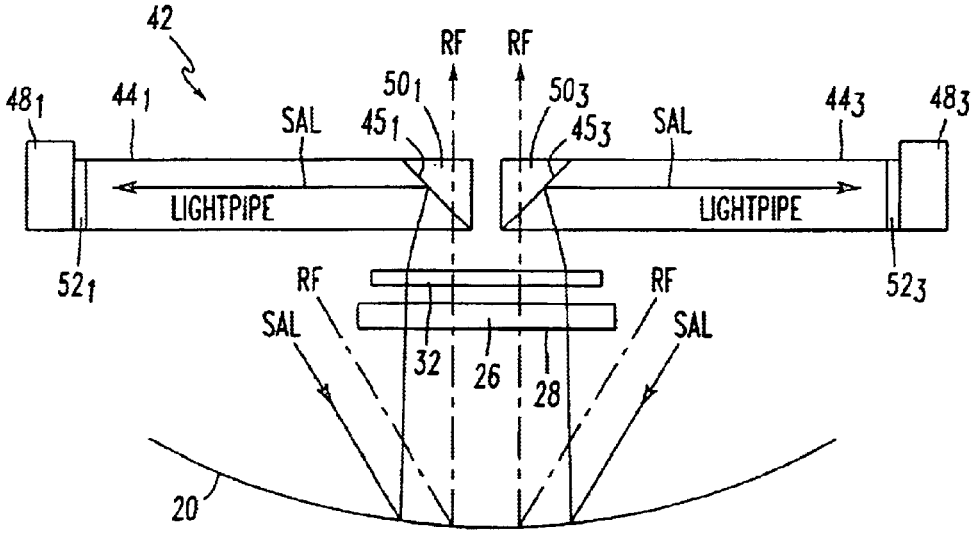
FIG. 9 is a diagram illustrative of the RF and laser energy propagation in the elements shown in FIGS. 6–8.

Located in front of the IR relay optics cell 22 is apparatus which adjacently locates a laser sensor assembly for SAL signal collection and an RF sensor assembly including a waveguide feed member while separating the RF and laser energy beams for separate detection. The IR and RF functions of the seeker remain substantially the same as if the laser sensor assembly is not present. This is achieved by locating a dielectric mirror 26 of a secondary mirror assembly and having a dielectric coating 28 which is designed to reflect IR energy while transmitting millimeter wave (MMW) RF energy and semi-active laser (SAL) energy therethrough in a joint or common signal path as shown in FIG. 9, for example, by reference numeral 30. The secondary mirror 26 is mounted on a support member 31 which is secured to the primary mirror assembly 18. Directly in front of the secondary mirror 26 is a diffractive element 32 in the form of a diffractive lens which acts to focus the laser energy on a laser energy sensor assembly 34, while not affecting the RF signal. The diffractive lens 32 is similar to a Fresnel lens in that there are small surface variations in the element which acts as a lens, yet the overall surface profile tends to be flat. The surface variations in the diffractive lens 32 are held to "microscopic levels" compared to RF wavelengths so that the RF will not react to these dimensions while the much shorter optical wavelengths will react to them. By inserting a diffractive lens 32 adjacent the dielectric secondary mirror 26, the optical signal can be focused significantly short from a focus of the RF energy as shown in FIG. 4 to a surface 36 of a bifurcated RF waveguide member 38 as shown in FIG. 5 which is adapted to couple RF energy to a transceiver circuit board 40 located behind the primary mirror assembly 18. The small focus difference between the SAL energy and the RF energy is attributed to chromatic aberration in the optical materials of the secondary mirror 26 and the coating 28, as well as the radome 10. The laser sensor requires that the image be at or near a good focus of the sensor. By the insertion of the diffractive lens 32 behind the secondary mirror 26, the optical signal (SAL) can be focused significantly short from the RF focus.

Figure 2:
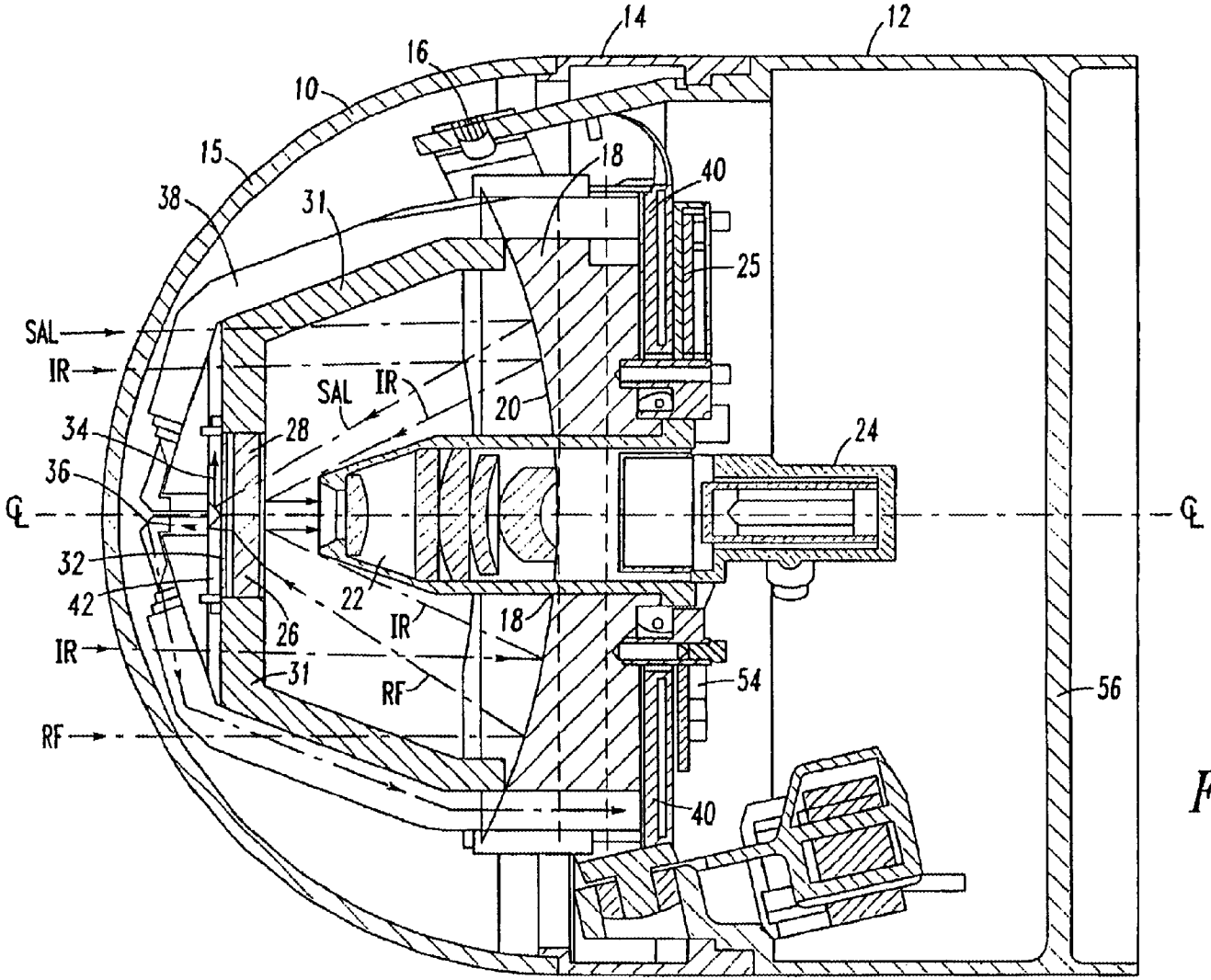
FIG. 2 is a longitudinal central cross section of the embodiment of the invention shown in FIG. 1.

If an optical detector were to be placed at the optical focus of the SAL energy, it would block and therefore interfere with the RF signal. Accordingly, the first embodiment of the invention shown in FIGS. 1 and 2 is to employ a light pipe assembly 42 shown in FIGS. 6–8 which acts to divert and channel the optical signal (SAL) to the side where optical detectors are located without RF or mechanical interference being an issue. As shown, four light pipe members $\mathbf{44}_1$, $\mathbf{44}_2$, $\mathbf{44}_3$ and $\mathbf{44}_4$ are orthogonally supported by four pie-shaped elements $\mathbf{46}_1$, $\mathbf{46}_2$, $\mathbf{46}_3$ and $\mathbf{46}_4$. The light pipe members $\mathbf{44}_1 \ldots \mathbf{44}_4$ include surfaces $\mathbf{45}_1$, $\mathbf{45}_2$, $\mathbf{45}_3$ and $\mathbf{45}_4$ angulated at 45° which capture the SAL energy at its focus and propagate it to a peripheral region for coupling to four laser detectors $\mathbf{48}_1$, $\mathbf{48}_2$, $\mathbf{48}_3$ and $\mathbf{48}_4$. Four prism shaped filler elements $\mathbf{50}_1$, $\mathbf{50}_2$, $\mathbf{50}_3$ and $\mathbf{50}_4$ are located at the center of the assembly for spacing and support. Also shown, located between the light pipes $\mathbf{44}_1 \ldots \mathbf{44}_4$ and the respective detectors $\mathbf{48}_1 \ldots \mathbf{48}_4$ are respective screen members $\mathbf{52}_1$ $\mathbf{52}_4$ for providing electromagnetic energy interference (EMI) shielding.

It should be noted that the RF views the light pipes $\mathbf{44}_1 \ldots \mathbf{44}_4$ as well as the filler elements $\mathbf{50}_1 \ldots \mathbf{50}_4$ as simply a dielectric plate, i.e. a window, so as to pass through it unobstructed as shown in FIG. 9. The light pipes usually depend on total internal reflection for trapping signals and directing them to the exit surface. If needed, dielectric mirror coatings can also be employed.

Figure 3:
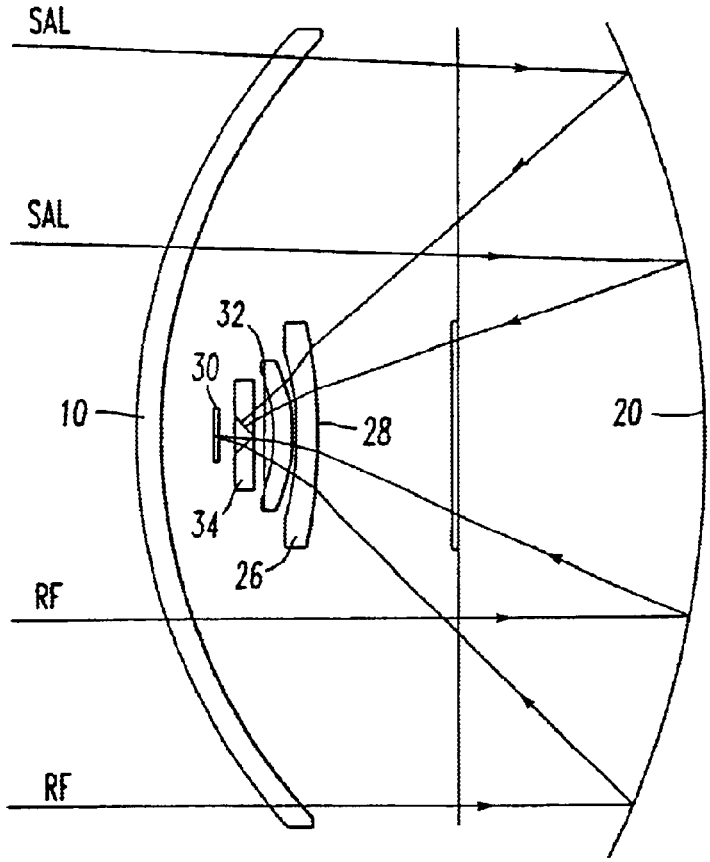
FIGS. 3, 4 and 5 are diagrams illustrative of RF and semi-active laser (SAL) energy propagation in the embodiment shown in FIG. 1.

As shown in FIGS. 3, 4 and 5, the diffractive lens 32 is shown bent into a meniscus shape so the local zones of the surface will be at near normal to the incident rays of SAL.

Thus, the RF signal and the SAL signal reflected from the primary mirror 20 as shown in FIG. 9, share a common signal path through the secondary mirror 26 and the diffractive lens 32, with the SAL energy being extracted by the light pipe assembly 42, while the RF energy propagates substantially unobstructed to the surface 36 of the waveguide element 38, shown in FIG. 2. The outputs of the laser energy detectors $\mathbf{48}_1 \ldots \mathbf{48}_4$ are coupled by means of cabling, not shown, to a post amplifier buffer board assembly 54 located at the rear of the mirror assembly 18.

Although not shown, digital signal processing circuitry including RF, SAL and IR signal processors connected to the circuit boards 25, 40 and 54, is located behind the flat rear wall 56 of the housing 12.

Figure 10:
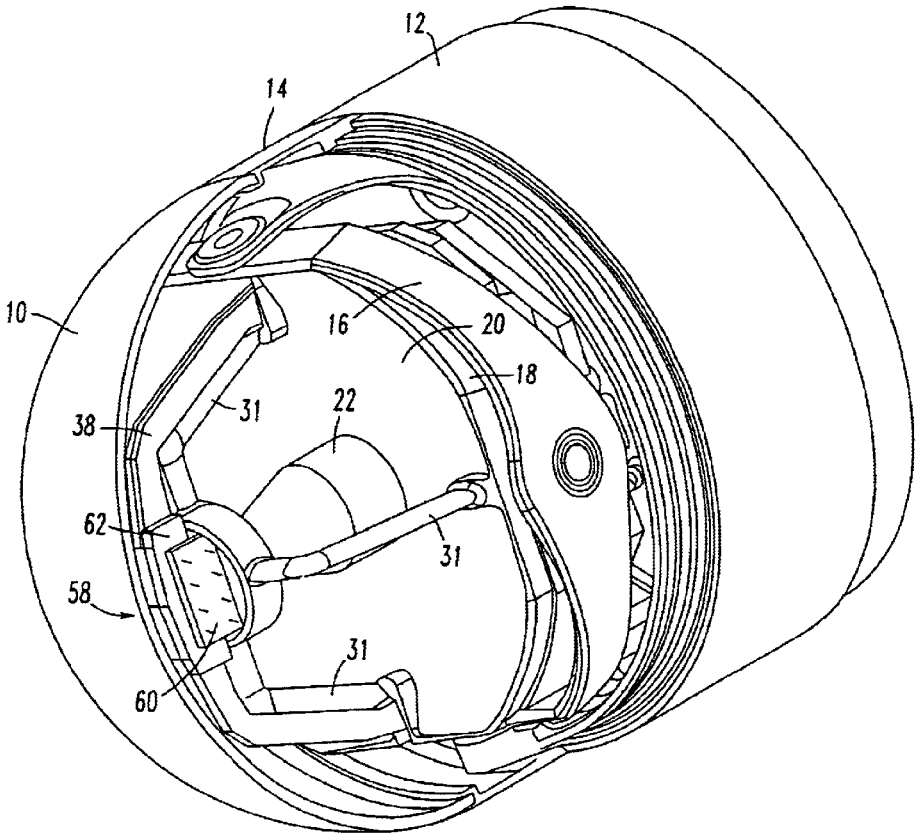
FIG. 10 is a partially cutaway isometric view of a second embodiment of the subject invention.
Figure 11:
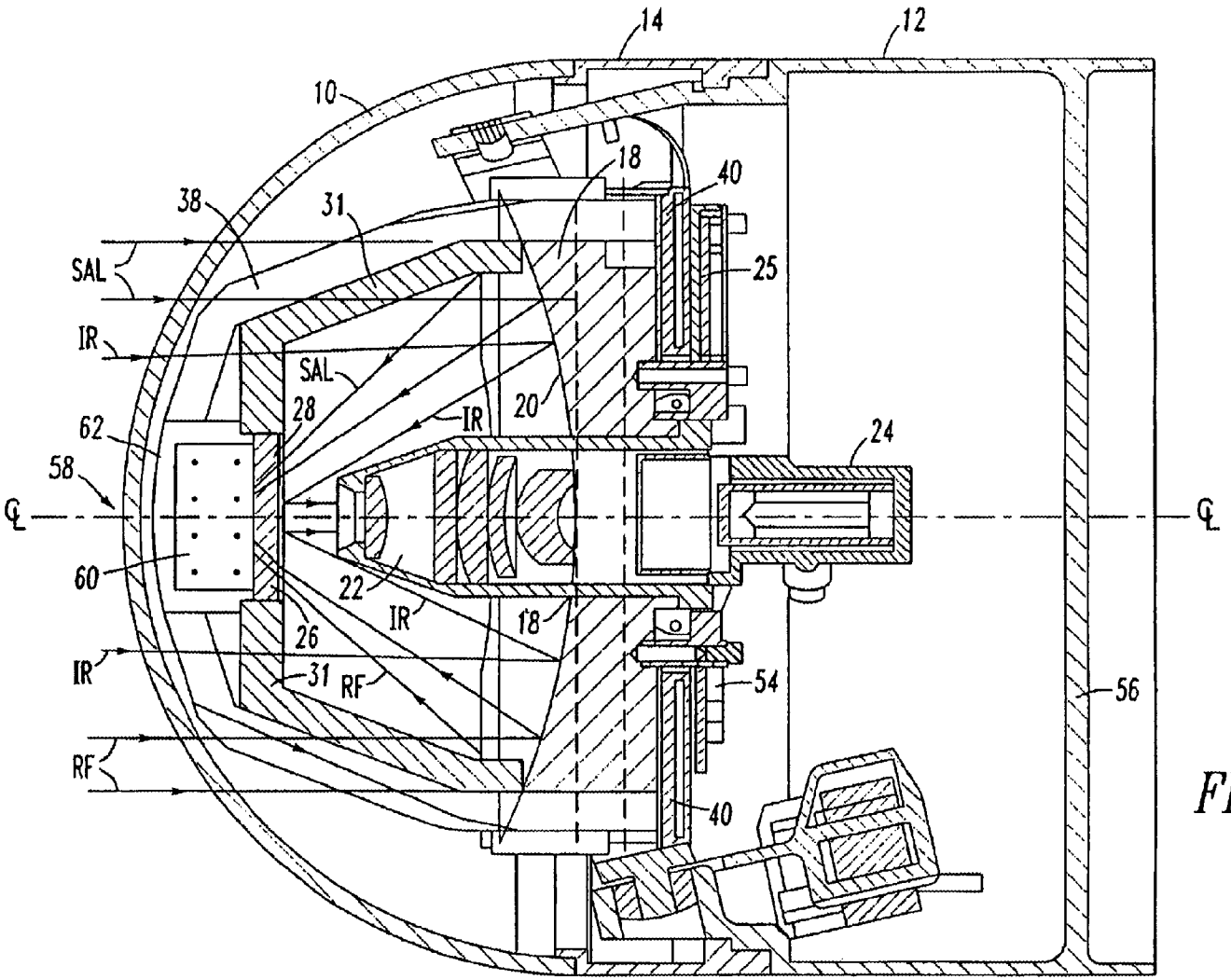
FIG. 11 is a longitudinal central cross-sectional view of the embodiment shown in FIG. 10.
Figure 12:
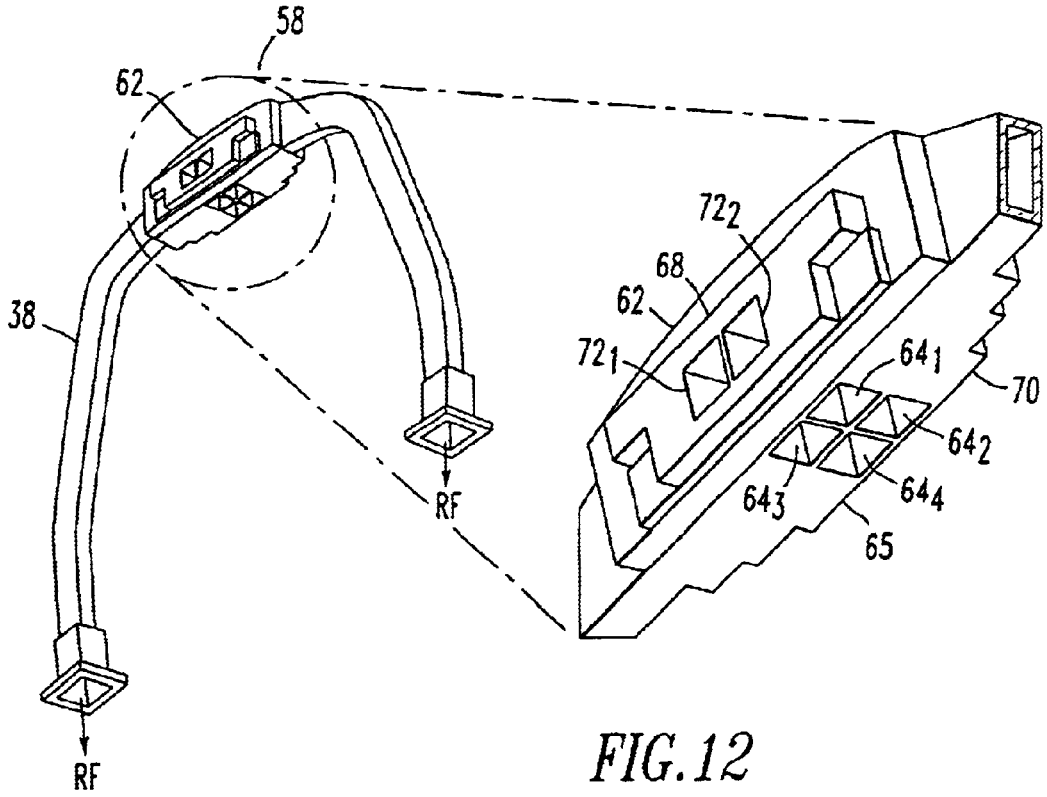
FIGS. 12 and 13 are perspective views of the elements used in the embodiment shown in FIGS. 10 and 11 for separating and diverting the RF and laser energy propagating in a common RF-optical path following passage through the secondary mirror.
Figure 13:
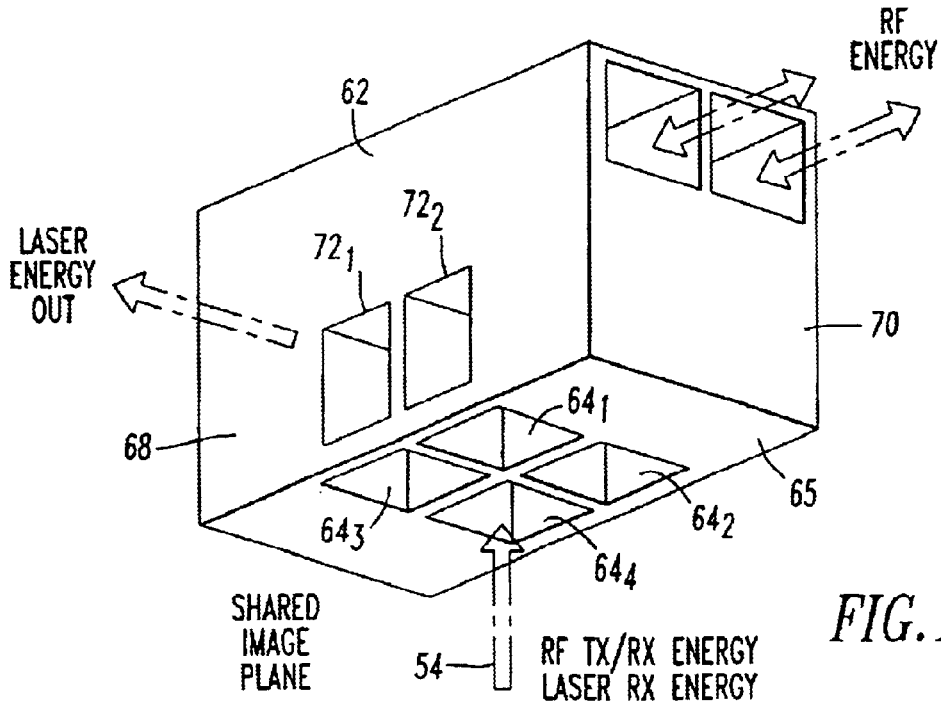

Referring now to the second embodiment of the subject invention, reference is now made to FIGS. 10–15. This embodiment is structurally the same as the first embodiment shown in FIGS. 1 and 2, with the exception of the manner in which the laser energy (SAL) is extracted from the common signal path 30 (FIG. 9) including the RF. The second embodiment locates the laser energy sensor assembly and the RF sensor assembly at a common focal point which is at the mid-point 58 of the RF feed waveguide member 38 shown in FIGS. 10 and 11 and where RF and laser energy beams split for separate detection. Also, the laser energy detectors are mounted directly on the waveguide 38 as shown in FIG. 10. There reference numeral 60 denotes an assembly for the laser energy detectors attached to a common RF feed SAL collector section 62 of the waveguide member 38 as shown in FIG. 12. In this embodiment, the diffractive lens 32 (FIG. 2) of the first embodiment is eliminated and both the RF and laser (SAL) energy now pass through the secondary mirror 26 to four rectangular openings $\mathbf{64}_1$, $\mathbf{64}_2$, $\mathbf{64}_3$ and $\mathbf{64}_4$ in the bottom face 65 of the waveguide section 62 which provides a shared image plane. Four beam splitting prisms $\mathbf{74}_1$, $\mathbf{74}_2$, $\mathbf{74}_3$ and $\mathbf{74}_4$ are located internally of the waveguide section 62 adjacent the rectangular openings $\mathbf{64}_1$, $\mathbf{64}_2$, $\mathbf{64}_3$ and $\mathbf{64}_4$ to reflect the SAL energy at an angle of 90° so as to direct the laser energy out of the side surfaces 68 and 70 via four rectangular openings $\mathbf{72}_1 \ldots \mathbf{72}_4$, two of which are shown by reference numerals $\mathbf{72}_1$ and $\mathbf{72}_2$ in FIGS. 12 and 13. When desirable, the rectangular openings $\mathbf{72}_1 \ldots \mathbf{72}_4$ could be configured as an array of small holes, not shown. A dielectric mirror coating consisting of a non-metallic coating, so as not to disrupt RF transmission, is further included on the prism surfaces $\mathbf{67}_1 \ldots \mathbf{67}_4$ to achieve the internal reflection needed to make the 90° reflection of the laser energy out of the side openings $\mathbf{72}_1 \ldots \mathbf{72}_4$ in the side walls 68 and 70 of the waveguide collector section 62. Filler prisms $\mathbf{66}_1 \ldots \mathbf{66}_4$ with similar dielectric characteristics are added to make the assemblies appear as a single uniform block to the RF energy passing therethrough. The length of this block is furthermore optimized so as to reduce the RF attenuation in/or reflection by extending the length further up into the waveguide section 62 if need be.

A pair of screen members $\mathbf{76}_1$ and $\mathbf{76}_2$ are shown in FIGS. 14 and 15 for providing EMI shielding of the laser light energy exiting the openings $\mathbf{72}_1$, $\mathbf{72}_2 \ldots \mathbf{72}_4$ out of the side walls 68 and 70. Four SAL energy detectors of the laser energy detector assembly 60 shown in FIG. 10, two of which are shown by reference numerals $\mathbf{60}_1$ and $\mathbf{60}_2$ in FIG. 15, are attached to the side walls 68 and 70 of the waveguide section 62.

Although not shown, the 90° bend in the SAL light path can be achieved by using optical fiber fused into a block. Before the blocks of fiber are fused, the fiber is positioned so that a point of light input and output of the fiber is normal to the faces of the blocks that will be cut and polished. Filler material would also be required, but this would be fused to the fiber as well. The length of the block is also customized in order to limit the impact of the RF energy impinging thereon.

A slightly defocused laser image may be desired for tracking purposes. This can be accommodated by extending the prisms or fused fiber blocks that pass the openings $\mathbf{64}_1 \ldots \mathbf{64}_4$ in the face 65 of the waveguide section 62 shown in FIGS. 12 and 13.

In the event that an optical bandpass filter is required to pass the laser energy but allowing minimal solar irradiation to reach the laser detectors, such a filter could be applied to the surface of the secondary mirror 26, while still allowing full aperture collection and proper optical band filtering.

While the concepts presented heretofore have been presented in the context of a tri-mode seeker, it should be noted that it is not necessarily limited to tri-mode co-boresighted missile seekers. It can also be employed in connection with any application in which laser light or other optical energy and RF energy are collected, utilizing the same aperture.

The foregoing detailed description merely illustrates the principles of the invention. It will thus be appreciated that those skilled in the art will be able to devise the various arrangements, which, although not explicitly described or shown herein, embody the principles of the invention and are thus within its spirit and scope.

What is claimed is:

1. A multi-mode co-boresighted sensor system mounted on a gimbal assembly of an airborne platform, comprising:

RF sensor means for sensing RF energy;

first optical sensor means for sensing a first type optical energy;

second optical sensor means for sensing a second type optical energy;

primary mirror assembly having a common collecting aperture for the RF energy and the first and second type optical energy;

secondary transmissive/reflective mirror assembly located forward of a focal region of the primary mirror assembly for permitting propagation of RF energy and first type optical energy therethrough to the focal region of the primary mirror assembly and having a reflective surface for reflecting said second type optical energy rearward to said second optical sensor means;

said RF sensor means and said first optical sensor means being located at said focal region on an opposite side of the secondary mirror assembly from said second optical sensor means;

whereby said RF energy and said first type optical energy simultaneously uses the full collecting aperture of the reflecting surface of the primary mirror assembly along with the second type optical energy as well as sharing a common signal path through said secondary mirror assembly to said RF sensor means and said first optical sensor means.

2. A sensor system according to claim 1 wherein said first optical sensor means comprises laser energy sensor means, wherein said second optical sensor means comprises infrared energy sensor means, wherein said RF sensor means comprises millimeter wave RF sensor means.

3. A sensor system according to claim 1 wherein said first type optical energy comprises laser energy, said second type optical energy comprises infrared (IR) energy and said RF energy comprises millimeter wave (MMW) RF energy.

4. A multi-mode co-boresighted transmitting/receiving sensor system for a seeker, comprising:

an RF sensor assembly for sensing RF energy;

a laser energy sensor assembly for sensing laser energy;

an infrared energy sensor assembly for sensing IR energy;

a primary mirror assembly having a common collecting aperture for the RF energy and the laser and IR energy;

a secondary transmissive/reflective mirror assembly located forward of a focal region of the primary mirror assembly for permitting propagation of RF energy and laser energy therethrough to the focal region of the primary mirror assembly and having a reflective surface for reflecting said IR energy rearward to the infrared energy sensor assembly;

said RF sensor assembly and said laser energy sensor assembly being located at said focal region on an opposite side of the secondary mirror assembly from said infrared energy sensor assembly;

wherein said RF energy and said laser energy simultaneously uses the full collecting aperture of the reflecting surface of the primary mirror assembly along with the IR energy as well as sharing a common signal path through said secondary mirror assembly to said RF sensor assembly and said laser energy sensor assembly.

5. A sensor system according to claim 4 wherein said secondary mirror assembly intersects a central longitudinal axis of the primary mirror assembly.

6. A sensor system according to claim 5 wherein the secondary mirror assembly includes a dielectric member located orthogonal to said central longitudinal axis.

7. A sensor system according to claim 6 wherein said reflective surface of the secondary mirror assembly comprises dielectric means facing said infrared sensor.

8. A sensor system according to claim 7 wherein said dielectric means comprises a dielectric coating in a face of the dielectric member.

9. A sensor system according to claim 7 wherein said infrared energy sensor is located on said central longitudinal axis.

10. A sensor system according to claim 7 and additionally comprising light diffractive means located between the secondary mirror assembly and the laser energy sensor assembly for causing respective optical and RF focal planes in the focal region of the primary mirror assembly to separate so as to focus the laser energy on said first optical sensor assembly while propagating the RF energy unaffected thereby to the RF sensor assembly.

11. A sensor system according to claim 10 wherein said diffractive means comprises a diffractive lens.

12. A sensor system according to claim 10 wherein said laser energy sensor assembly includes at least one laser energy conductor for extracting and diverting the laser energy away from the common signal path of the laser energy and the RF energy to at least one side located laser energy detector element while providing substantially unobstructed propagation of the RF energy to the RF sensor assembly.

13. A sensor system according to claim 12 wherein said at least one laser energy conductor comprises a light pipe member having an angulated reflective surface in the common signal path of the laser energy and the RF energy.

14. A sensor system according to claim 13 wherein said at least one laser energy conductor comprises four mutually orthogonal light pipe members having respective angulated reflective surfaces at an inner end thereof located in the common signal path and wherein said at least one laser energy detector element comprises a set of laser energy detectors located at the outer end of said light pipe members.

15. A sensor system according to claim 14 and additionally including electromagnetic energy interference shielding elements located between each of said light pipe members and said laser energy detectors.

16. A sensor system according to claim 10 wherein said RF sensor assembly includes means for feeding RF energy in the focal region away from the focal region to an external RF detector.

17. A sensor system according to claim 16 wherein means for feeding RF energy comprises an RF waveguide member having an opening at the RF focal plane.

18. A sensor system according to claim 17 wherein said RF waveguide member comprises a bifurcated waveguide member having a central opening at the RF focal plane.

19. A sensor system according to claim 7 wherein the RF sensor assembly and the laser energy sensor assembly include energy collection means and RF energy feed means commonly located in the focal region of the primary mirror assembly and having a shared image plane.

20. A sensor system according to claim 19 wherein said laser energy collection means and said RF energy feed means are commonly located in a section of a waveguide member for feeding RF energy to an external RF detector and having an opening at said focal region.

21. A sensor system according to claim 20 wherein said section comprises a central waveguide section of a bifurcated waveguide member and wherein said section includes an opening at said focal region.

22. A sensor system according to claim 21 wherein said laser energy collection means includes laser energy reflection means located internally of the central waveguide section adjacent said opening for reflecting laser received from the primary mirror assembly out of at least one opening in a side surface of said waveguide section.

23. A sensor system according to claim 22 and additionally including laser energy detector means located adjacent said at least one opening exteriorally of said waveguide section for detecting laser energy reflected from said reflecting means.

24. A sensor system according to claim 23 wherein said laser energy reflecting means comprises a plurality of beam splitting prisms each having a reflecting surface angulated at 45° for reflecting laser energy at 90° to respective side openings in said waveguide section.

25. A sensor system according to claim 24 wherein said plurality of prisms comprises a set of four beam splitting prisms located side by side in said waveguide section and said laser energy detector means comprises a set of laser energy detectors located exteriorally of said waveguide section.

26. A sensor system according to claim 25 wherein said set of laser energy detectors are selectively attached to one or more side surfaces of said waveguide sections.

27. A sensor system according to claim 25 and additionally including a set of electromagnetic energy interference shielding elements located between said set of laser energy reflecting prisms and said set of laser energy detectors.

* * * * *